US006854596B1

(12) United States Patent
Wiese

(10) Patent No.: US 6,854,596 B1
(45) Date of Patent: Feb. 15, 2005

(54) TOILET PAPER STORAGE CONTAINER

(76) Inventor: Rose Lenihan Wiese, 1110 Timber Ridge Dr., Baden, PA (US) 15005

( * ) Notice: Subject to any disclaimer, the term of this patent is extended or adjusted under 35 U.S.C. 154(b) by 215 days.

(21) Appl. No.: 10/247,047

(22) Filed: Sep. 19, 2002

(51) Int. Cl.[7] ..... B65D 85/67
(52) U.S. Cl. ..... 206/225; 206/394; 206/457
(58) Field of Search ..... 206/233, 225, 206/581, 391, 294, 154, 165, 457

(56) References Cited

U.S. PATENT DOCUMENTS 4,369,929 A * 1/1983 Cayer ..... 242/423.1
4,432,451 A * 2/1984 Hooser ..... 206/216
5,040,679 A * 8/1991 Rehmann ..... 206/457
5,456,356 A * 10/1995 Kurzawa ..... 206/349
6,050,401 A * 4/2000 Michaelson ..... 206/225
6,109,429 A * 8/2000 Cunningham et al. ..... 206/15.2
6,193,059 B1 * 2/2001 Massaro ..... 206/225

* cited by examiner

*Primary Examiner*—Jacob K. Ackun, Jr.
(74) *Attorney, Agent, or Firm*—Aileen Champion Addessi

(57) ABSTRACT

A toilet paper storage container for storing bathroom and lavatory items such as toilet paper rolls and plungers includes a base for disposition on a floor surface with the base having an annular channel formed thereon. Mounted on the base is a cylinder having a lower end for positioning within the annular channel and an opposite upper open end through which toilet paper rolls can be placed for successively stacking the rolls within the cylinder. The cylinder can also accommodate standard plungers, having a suction end of the plunger positioned on the base and the rolls of toilet paper positioned about the handle of the plunger. The toilet paper storage container can be placed within a pliable cover that encloses the storage container therein.

18 Claims, 2 Drawing Sheets

TOILET PAPER STORAGE CONTAINER

BACKGROUND OF THE INVENTION

The present invention pertains to holders and containers primarily for residential use and, more particularly, pertains to a portable toilet paper storage container for holding rolls of toilet paper and other household cleaning items such as a plunger.

The storage of the wide variety of lavatory and bathroom items and products for cleaning, deodorizing, polishing, scrubbing, and sanitizing the fixtures, surfaces, walls, and rooms of residential dwellings presents problems of storage space, access, availability and safety. It is no longer the case that the enclosed storage space beneath the bathroom sink is able to hold all of a dwellings' bathroom, laundry, and general cleaning products. Hallway closets and shelving must also be utilized for additional storage space. Moreover, it is quite common that shelving and space in the kitchen, basement, and garage is also utilized.

However, the storage of bathroom and lavatory items and products is usually not haphazard since some items and products may be used on a daily basis, and therefore must be readily accessible. One item that is used on a daily basis and must be readily accessible is toilet paper. There isn't a generally consistent place for storing additional rolls of toilet paper and storage locations can include bathroom closets, hallway closets, underneath the bathroom sink, and on shelves and cabinets. Yet the additional toilet paper rolls must be stored in such a manner that they are accessible when needed but are protected from getting wet from normal bathroom use and from any accidental sprays or overflows from the bathroom sink, toilet bowl, bathtub or shower. Thus, there is a need for a convenient and protective way to store additional toilet paper rolls and other bathroom items.

SUMMARY OF THE INVENTION

The present invention comprehends an apparatus for storing commonly used household and personal hygiene items, and more particularly pertains to a portable toilet paper storage container for disposition on a floor surface in proximity to or adjacent a bathroom or lavatory facility.

The toilet paper storage container of the present invention includes a base, preferably circular, for disposition on the floor surface, and the base includes an annular channel formed thereon. Mounted to the base, and projecting upwardly therefrom, is a cylinder. The cylinder includes an upper open end for placing and storing the toilet paper within the cylinder and an opposite lower end for securement to the channel of the base. The cylinder may be opaque for concealing the rolls of toilet paper or may be transparent for allowing the individual to visually determine the number of rolls of toilet paper stored therein. The cylinder is able to accommodate the storage of a common bathroom plunger with the rolls of toilet paper successively stacked on the handle of the plunger.

In addition, the toilet paper storage container can be placed within a pliable cover, preferably of a durable and washable cloth material, for enclosure therein. An opening in the cover permits access to the toilet paper rolls stored within the cylinder.

It is an objective of the present invention to provide a toilet paper storage container that is lightweight, durable, and portable.

It is another objective of the present invention to provide a toilet paper storage container capable of holding a sufficient number of extra toilet paper rolls but that can be unobtrusively placed in or adjacent to a bathroom or lavatory facility.

Yet another objective of the present invention is to provide a toilet paper storage container that includes an aesthetically appealing clothe-type cover into which the toilet paper storage container can be placed while still allowing easy access to the toilet paper rolls.

Still another objective of the present invention is to provide a toilet paper storage container that can hold other household cleaning items like a common household plunger.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DETAILED DESCRIPTION OF THE PREFERRED EMBODIMENT

Illustrated in FIGS. 1–4 is a device for holding or containing commonly used household items and products; more specifically, the device shown in FIGS. 1–4 is a portable toilet paper storage container 10 for disposition on a floor surface 12, generally the bathroom floor, so that the individual or members of the residence have spare or extra toilet paper rolls 14 available and easily accessible.

Figure 1:
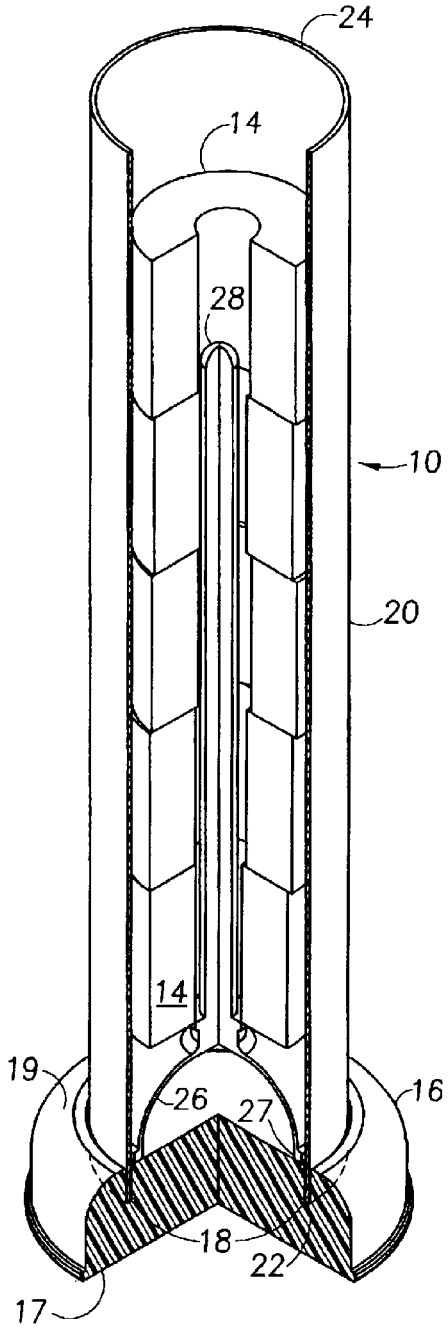
FIG. 1 is an isometric view of the toilet paper storage container of the present invention holding several rolls of toilet paper therein.
Figure 2:
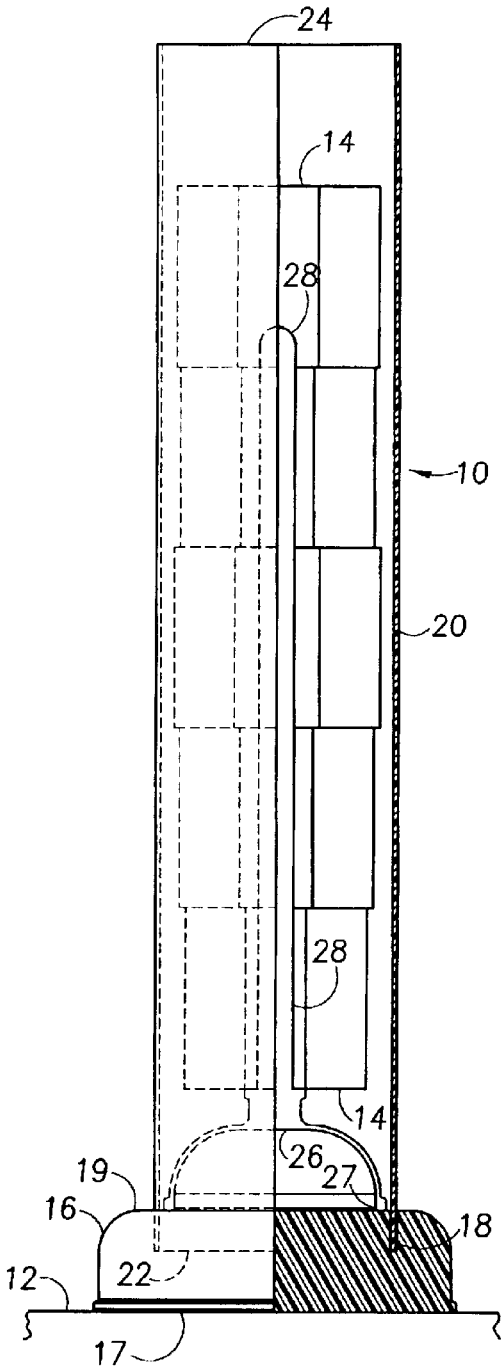
FIG. 2 is an elevational view of the toilet paper storage container of the present invention illustrating the disposition of a plunger within the cylinder.

The toilet paper storage container 10 of FIGS. 1–2 includes a base or platform 16 for disposition on the floor surface 12. The base 16 is preferably circular-shaped, although the base 16 could be in the form of a number of polygonal geometric shapes, such as pentagonal, octagonal, etc. The base 16 has a bottom side 17 that is disposed contiguous to the floor surface 12 and an opposite upper side 19. Formed on the upper side 19 of the base 16 is an annular channel or groove 18. The size and dimensions of the base 16 should be sufficient to support and prevent the tilting or tipping over of structural elements hereinafter described. The base 16 may be solid, hollow, or combinations thereof. The base 16 may be formed of plastic, wood, or any suitable type of material.

Illustrated in FIGS. 1 and 2 is the structure that actually holds or stores the household items and products, primarily the spare or extra toilet paper rolls 14, for easy access and use. Specifically, shown in FIGS. 1 and 2 is an elongated, hollow cylinder 20 that mounts to the base 16 and extends upwardly therefrom. Although the height of the cylinder 20 can be variable, a height of approximately 30 inches is adequate for holding at least five rolls of toilet paper 14 for easy storage and removal as needed. A cylinder of much greater height would inhibit the easy removal of the contained toilet paper rolls 14, while a shorter cylinder would not permit the storage of enough rolls of toilet paper 14 to make the device useful.

The cylinder 20 includes a lower end 22 that is slipped or received into the channel 18 of the base 16 for mounting the cylinder 20 thereto, and an opposite upper open end 24 through which the rolls of toilet paper 14 can be successively inserted for stacking and storing within the cylinder 20. The cylinder 20 may rest on the base 16 or may be attached thereto, such as adhesively, by mechanical means, or other suitable means.

The cylinder 20 may be opaque for concealing the toilet paper, transparent (for example, composed of clear plastic) for allowing a visual determination of the number of rolls of toilet paper 14 stored within the cylinder 20, or combinations thereof. The cylinder 20 may be formed of PVC, Plexiglas, plastic, wood, or any suitable type of material.

As shown in FIG. 2, the cylinder 20 is sized to accommodate a common household plunger 26. The plunger 26 has a suction end 27 that rests on the upper side of the base 16 and a handle 28 which extends upwardly within the cylinder 20. The rolls of toilet paper 14 can then be successively stacked on the handle 28 of the plunger 26 and removed therefrom as needed. To retrieve a roll of toilet paper 14 from within the cylinder 20, either the toilet paper 14 can be grasped or the handle 28 of the plunger 26 can be grasped and the plunger 26 withdrawn from the cylinder 20 to pull out the toilet paper 14 positioned closer to the suction end 27.

Figure 3:
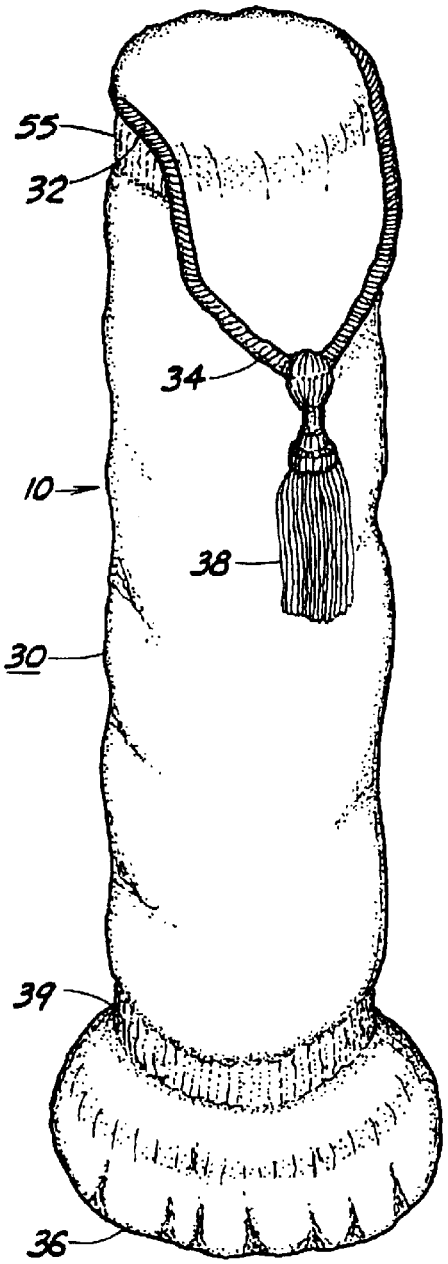
FIG. 3 is an isometric view of the toilet paper storage container of the present invention illustrating a clothe-type cover within which the toilet paper storage container can be placed.

Illustrated in FIG. 3 is an example of a cloth-type cover 30 that enhances the aesthetic appearance of the toilet paper storage container 10 and that can be designed to harmonize with the room decor. The clothe-type cover 30 is dimensioned slightly larger than the toilet paper storage container 10 so that the toilet paper storage container 10 can be received and completely enclosed therein. The cloth-type cover 30 can also serve as a portable carrying case for moving and transporting the toilet paper storage container 10 to different rooms or locations. The cover 30 is an elongated cylindrical sleeve having at least one opening. The cover 30 may have an opening 32 and a closed lower end for providing the portable carrying case. Alternatively, the cover 30 may have the upper opening 32 and a lower opening 36, allowing either open end 32 or 36 to be disposed over the cylinder 20 and base 16.

The cover 30 may have a flap 34 that can be selectively opened and closed to allow the insertion and removal of the toilet paper storage container 10 and the toilet paper rolls 14 through the opening 32. Closure of the flap 32 can be provided by any standard method such as fibrous adhesive patches marketed under the tradename Velcro, a zipper, buttons, hooks, simply folded over the opening 32, or the like. The flap 34 may include a tassel 38 for enhancing the aesthetic appeal of the cover 30.

The cover 30 may include an elasticized area 39, such as a fabric covered elastic band, or the like, for providing a snug fit of the cover 30 onto the cylinder 20. The cover 30 may include a second elasticized area 55 positioned at an upper portion or near the open end 32 for supporting the cover 30 while the flap 34 is opened to remove the toilet paper rolls 14. The elasticized area 55 prevents the cover 30 from sliding down the cylinder 20. The cover 30 may include one elasticized area 39 and one elasticized area 55 or may include several areas 39 and 55 or combinations thereof.

The cover 30 may be formed of any suitable type of fabric, and preferably, is washable for easy care of the cover 30. The fabric may have various designs, for example, holiday or seasonal designs, country motifs, a contemporary style, or the like to be visually appealing to the user.

For the various embodiments of this invention, the same reference characters will be used to designate like parts. In addition, like functions and like interactions of the parts among the various embodiments of this invention will not be repeated for each embodiment.

Figure 4:
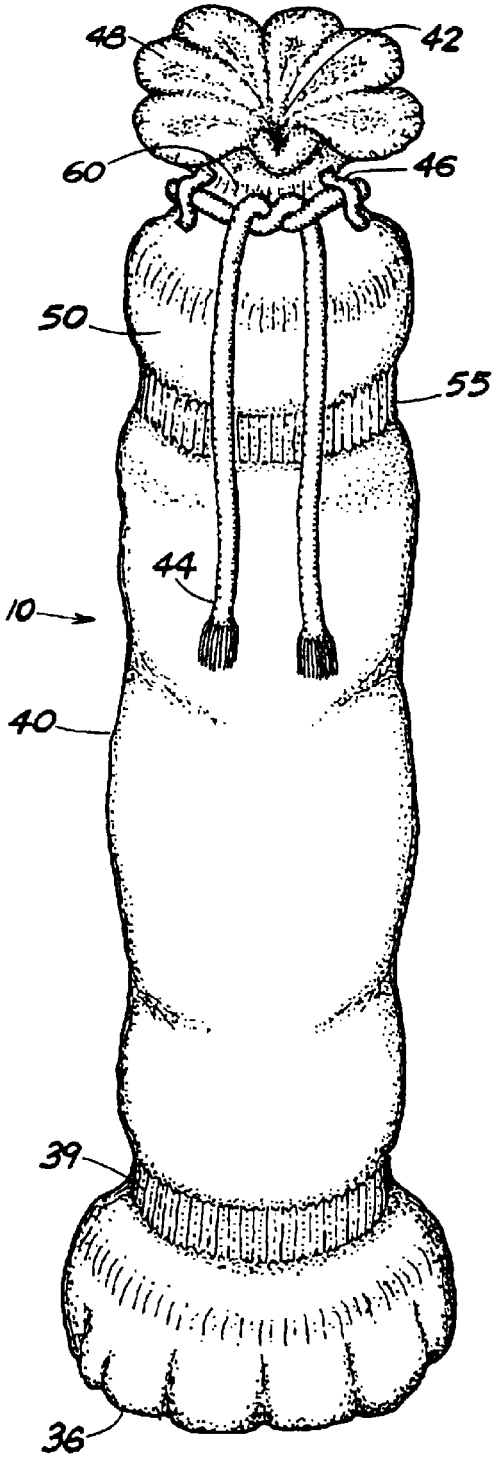
FIG. 4 is an isometric view of the toilet paper storage container of the present invention illustrating an alternative embodiment for the clothe-type cover.

Referring to FIG. 4 and using the same reference characters to define like parts, an alternative embodiment of the cover 30 as illustrated in FIG. 3 may be a cover 40 having like parts as the cover 30 and having an upper opening 42 through which the toilet paper rolls 14 may be inserted and removed. The cylinder 20 and the base 16 may be disposed through either the upper opening 42 or the lower opening 36. As one example, closure of the upper opening 42 is achieved by use of a drawstring 44 positioned about the cover 40, whereupon the top or upper end 42 of the cover 40 is gathered and as a result radially spread out or puffed out. For contrast the coloring, motifs, themes, and designs of the interior material 48 of the covers 30 and 40 of FIGS. 3 and 4 can be different than the coloring, motifs, themes, and designs of the exterior material 50 of the covers 30 and 40.

The drawstring 44 may be positioned within one loop 46, may be inserted through a plurality of loops 46, may be positioned within a pocket or sleeve that may be closed or partially opened for containing the drawstring 44 therein, or any other suitable type of design. The drawstring 44 and the loop 46 may be made out of a matching or coordinating fabric, may be a decorative cord, may be elastic, or may be any other type of closure device. The drawstring 44 can be easily removed for washing the cover 40. The drawstring 44 may be tied to close the opening 32 or may be untied to easily open the top of the cover 40 to access the toilet paper 14 and the plunger 26.

The cover 40 may include a third elasticized area 60. The third elasticized area 60 may be positioned within the cover 40, between the layers of the fabric of the cover 40, about the cover 40, or the like. The third elasticized area 60 is, preferably, a light elastic or looser elastic area than the first and second elasticized areas 39 and 55 for enabling access through the third elasticized area 60 to access the toilet paper 14 and the plunger 26. The drawstring 44 is positioned about the third elasticized area 60 which aids in gathering and tying the drawstring 44.

Thus there has been shown and described a novel toilet paper storage container which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A toilet paper storage container for holding rolls of toilet paper, comprising:

a base having an upper side and a bottom side, the bottom side positionable on a floor surface;

an elongated cylinder positioned on the base and extending upwardly therefrom;

the cylinder having a lower end for contacting the upper side of the base and an upper open end for receiving the rolls of toilet paper therethrough so that the rolls of toilet paper can be successively stacked within the cylinder and removed therefrom, and a pliable fabric cover including a cylindrical sleeve having at least one open end, the fabric cover enclosing the base and the cylinder therein, the at least one open end including an upper open end selectively openable for providing direct access to the toilet paper rolls while the fabric cover remains about the cylinder and closeable for concealing the toilet paper rolls in the fabric cover.

2. The toilet paper storage container for holding rolls of toilet paper of claim 1, wherein the base includes an annular channel and the lower end of the cylinder is mounted into the annular channel of the base.

3. The toilet paper storage container for holding rolls of toilet paper of claim 1, wherein a plunger having a handle can be placed within the cylinder for storage therein and the rolls of toilet paper can be successively stacked on the handle of the plunger and removed therefrom.

4. The toilet paper storage container for holding rolls of toilet paper of claim 1, further comprising the fabric cover having a flap attached to the upper open end of the fabric cover for selectively opening and closing the upper open end of the fabric cover for accessing and enclosing the toilet paper rolls.

5. The toilet paper storage container of claim 1, wherein the cover includes at least one elasticized area extending circumferentially about the cylinder.

6. The toilet paper storage container of claim 1, wherein the cover includes a lower end, the lower end having a first elasticized area for providing a snug fit of the cover onto the cylinder and a second elasticized area positioned at the upper open end for supporting the cover during removal of the toilet paper rolls.

7. The toilet paper storage container of claim 1, wherein the cylinder is opaque for concealing the rolls of toilet paper therein.

8. The toilet paper storage container of claim 1, wherein the cylinder is transparent for permitting visual determination of the number of rolls of toilet paper that are contained within the cylinder.

9. A toilet paper storage container for holding rolls of toilet paper, comprising:

a base having a circular channel formed therein;

a cylinder having an upper open end for receiving the rolls of toilet paper and an opposite lower end for positioning within the channel, the cylinder extending upwardly from the base so that the rolls of toilet paper can be successively stacked within the cylinder and removed therefrom; and a cover for receiving and enclosing therein the base and cylinder and having at least one open end for allowing the rolls of toilet paper to be removed from the cylinder and through the open end of the cover, the cover including a drawstring positioned at an upper open end for enabling the open end to be closed by gathering the cover with the drawstring, the cover including an interior material and an exterior material so that when the drawstring is positioned about the cover to close the open end of the cover, the interior material is foldable outwardly for creating a poofed style and exposing the interior material.

10. The toilet paper storage container of claim 9, wherein a plunger having a handle can be placed within the cylinder for storage therein and the rolls of toilet paper can be successively stacked on the handle of the plunger and removed therefrom.

11. The toilet paper storage container of claim 9, wherein the cover includes at least one elasticized area.

12. The toilet paper storage container of claim 9, wherein the cover includes a first elasticized area for providing a snug fit of the cover onto the cylinder and a second elasticized area positioned at the open end for supporting the cover during removal of the toilet paper rolls.

13. The toilet paper storage container of claim 9, wherein the cover includes a flap for closing the upper open end.

14. A toilet paper storage container for holding rolls of toilet paper and a plunger having a suction end and a handle, comprising:

a base having an upper side and a bottom side, the bottom side positionable on a floor surface;

a cylinder having a lower end for positioning on the base and an opposite upper open end extending upwardly from the base, the plunger positionable within the cylinder by disposing the plunger through the upper open end of the cylinder and positioning the suction end of the plunger on the base, the handle of the plunger extending upwardly from the base and within the cylinder;

the rolls of toilet paper positionable within the cylinder about the handle of the plunger so that the rolls of toilet paper can be successively stacked within the cylinder and removed therefrom, and a pliable fabric cover having at least one open end, the fabric cover positionable about the cylinder and base for receiving and enclosing therein the cylinder and the base the at least one open end for inserting and removing the rolls of toilet paper therethrough, one of the at least one open ends of the fabric cover having a flap attached to the fabric cover and extending from the open end, the flap closeable about the at least one open end for enclosing the toilet paper rolls within the fabric cover.

15. The toilet paper storage container of claim 14, wherein the cylinder is transparent for permitting visual determination of the number of rolls of toilet paper that are contained within the cylinder.

16. The toilet paper storage container of claim 14, further comprising:

the cover having an elasticized area positioned near the at least one open end and having at least one loop attached thereto; and a drawstring inserted through the at least one loop of the cover and extendable about the elasticized area of the cover for gathering the cover therebetween for closing the open end of the cover.

17. The toilet paper storage container of claim 14, wherein the cover includes an elasticized area positioned near the at least one open end and extending circumferentially thereabout for supporting the cover during removal of the toilet paper rolls.

18. The toilet paper storage container of claim 14, wherein the cylinder is sized for holding approximately five rolls of toilet paper therein.

* * * * *